US006524263B2

(12) United States Patent
Chen

(10) Patent No.: US 6,524,263 B2
(45) Date of Patent: Feb. 25, 2003

(54) PROGRAMMABLE NECK MASSAGING DEVICE

(76) Inventor: Rui Chen, 726 60th St. #3, Brooklyn, NY (US) 11220

( * ) Notice: Subject to any disclaimer, the term of this patent is extended or adjusted under 35 U.S.C. 154(b) by 85 days.

(21) Appl. No.: 09/901,776

(22) Filed: Jul. 10, 2001

(65) Prior Publication Data

US 2003/0013996 A1 Jan. 16, 2003

(51) Int. Cl.[7] ..... A61H 23/02
(52) U.S. Cl. ..... 601/57; 601/70
(58) Field of Search ..... 601/46, 48, 49–54, 601/56–61, 67–71, 78–81, 84, 39, 89–93; 602/18; 340/575, 576; D24/200, 215

(56) References Cited

U.S. PATENT DOCUMENTS 4,203,098 A * 5/1980 Muncheryan ..... 340/575
4,343,303 A * 8/1982 Williams ..... 601/46
5,018,511 A * 5/1991 Yokoi ..... 601/84
5,076,264 A * 12/1991 Lonardo et al. ..... 602/18
5,344,437 A * 9/1994 Pistay ..... 601/58
5,374,238 A * 12/1994 Xiao ..... 601/57
5,411,468 A * 5/1995 Chen ..... 601/57
5,568,127 A * 10/1996 Bang ..... 340/575
5,691,693 A * 11/1997 Kithil ..... 340/575
5,792,082 A * 8/1998 Yamanaka et al. ..... 601/148

FOREIGN PATENT DOCUMENTS

CH 639268 A * 11/1983 ..... 601/57

* cited by examiner

*Primary Examiner*—Danton D. DeMille
*Assistant Examiner*—Quang D. Thanh
(74) *Attorney, Agent, or Firm*—Goldstein & Lavas, P.C.

(57) ABSTRACT

A programmable neck massaging device including a base member positionable at a lower back of a user. The base member has a massaging element disposed therein for providing a massaging action to the lower back of the user. A back support arm is removably coupled with respect to the base member. A neck support is positionable around a neck of the user. The neck support is secured to the back support arm. The neck support has a generally U-shaped configuration defined by opposed free ends. The neck support includes a pair of massaging elements disposed within the opposed free ends thereof. A control panel is secured to the neck support. The control panel is in communication with the massaging element of the base member and the pair of massaging elements of the neck support. The control panel includes a timer. The timer has control buttons. The control panel includes a display. The control panel programs the activation of the massaging elements at timed intervals.

5 Claims, 3 Drawing Sheets

Fig. 1
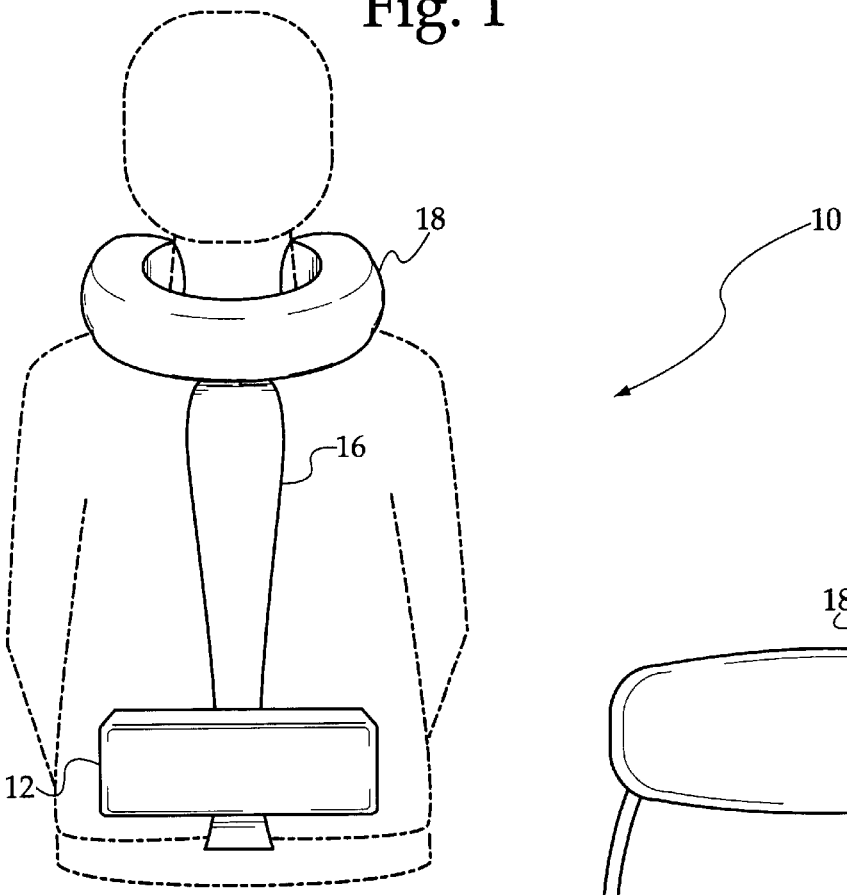
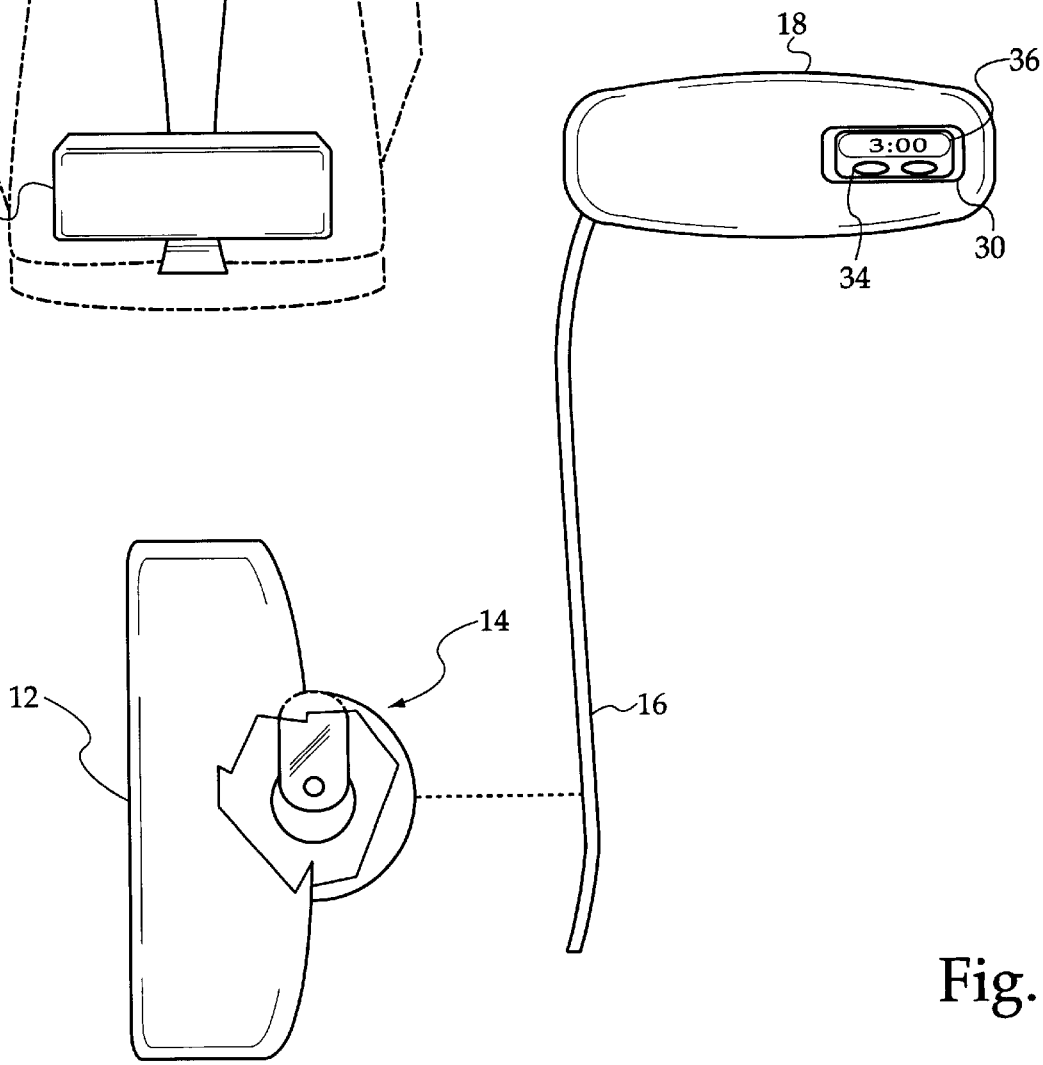
Fig. 2

Fig. 5
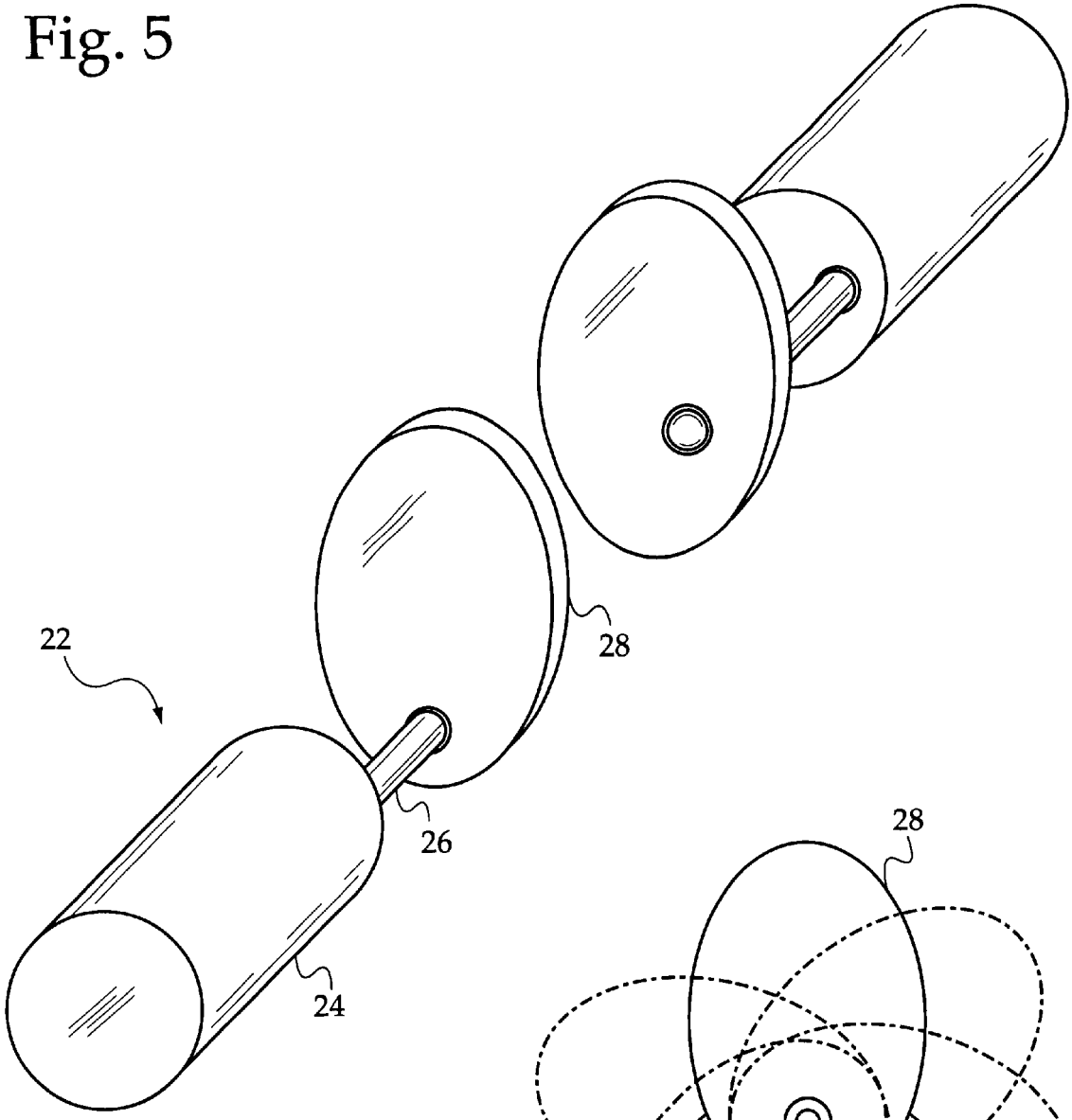
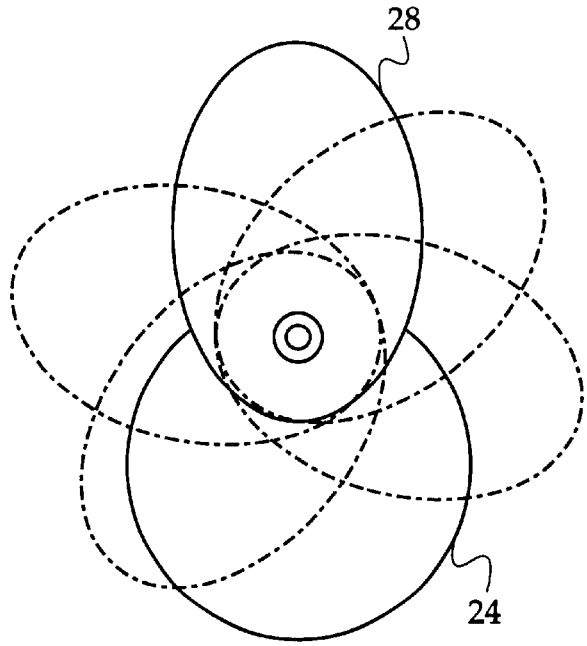
Fig. 6

PROGRAMMABLE NECK MASSAGING DEVICE

BACKGROUND OF THE INVENTION

The present invention relates to a programmable neck massaging device and more particularly pertains to providing massaging action to a neck of a person at set intervals to prevent the person from falling asleep.

The use of alerting devices is known in the prior art. More specifically, alerting devices heretofore devised and utilized for the purpose of waking up people are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,568,127 to Bang discloses a neck support device with means to alert the user with a tactile or aural stimulus to warn of drowsiness that is worn around the neck. U.S. Pat. No. 5,072,429 to Mair discloses a pillow with a wake up alarm incorporated. U.S. Pat. No. 5,691,693 to Kithil discloses a means for detecting if a driver is impaired due to factors such as sleepiness, comprised of sensors incorporated in the head liner of a vehicle.

While these devices fulfill their respective, particular objective and requirements, the aforementioned patents do not describe a programmable neck massaging device for providing massaging action to a neck of a person at set intervals to prevent the person from falling asleep.

In this respect, the programmable neck massaging device according to the present invention substantially departs from the conventional concepts and designs of the prior art, and in doing so provides an apparatus primarily developed for the purpose of providing massaging action to a neck of a person at set intervals to prevent the person from falling asleep.

Therefore, it can be appreciated that there exists a continuing need for a new and improved programmable neck massaging device which can be used for providing massaging action to a neck of a person at set intervals to prevent the person from falling asleep. In this regard, the present invention substantially fulfills this need.

SUMMARY OF THE INVENTION

In the view of the foregoing disadvantages inherent in the known types of alerting devices now present in the prior art, the present invention provides an improved programmable neck massaging device. As such, the general purpose of the present invention, which will be described subsequently in greater detail, is to provide a new and improved programmable neck massaging device which has all the advantages of the prior art and none of the disadvantages.

To attain this, the present invention essentially comprises a base member positionable at a lower back of a user. The base member has a massaging element disposed therein for providing a massaging action to the lower back of the user. A back support arm is removably coupled with respect to the base member. The back support arm is curved to conform to a back of the user. The back support arm has an upper end and a lower end. The lower end is couplable with the base member. A neck support is positionable around a neck of the user. The neck support is secured to the upper end of the back support arm. The neck support has a generally U-shaped configuration defined by opposed free ends. The neck support includes a pair of massaging elements disposed within the opposed free ends thereof. Each of the massaging elements includes a motor portion. The motor portion has an arm extending outwardly therefrom. The arm has a rotating disc disposed thereon whereby activation of the motor will cause the rotating disk to spin in a constant circular motion. Each rotating disc has a generally oval configuration. A control panel is secured to the neck support. The control panel is in communication with the massaging element of the base member and the pair of massaging elements of the neck support. The control panel includes a timer. The timer has control buttons. The control panel includes a display. The control panel programs the activation of the massaging elements at timed intervals.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved programmable neck massaging device which has all the advantages of the prior art alerting devices and none of the disadvantages.

It is another object of the present invention to provide a new and improved programmable neck massaging device which may be easily and efficiently manufactured and marketed.

It is a further object of the present invention to provide a new and improved programmable neck massaging device which is of durable and reliable construction.

An even further object of the present invention is to provide a new and improved programmable neck massaging device which is susceptible of a low cost of manufacture with regard to both materials and labor, and which accordingly is then susceptible of low prices of sale to the consuming public, thereby making such a programmable neck massaging device economically available to the buying public.

Even still another object of the present invention is to provide a new and improved programmable neck massaging device for providing massaging action to a neck of a person at set intervals to prevent the person from falling asleep.

Lastly, it is an object of the present invention to provide a new and improved programmable neck massaging device including a base member positionable at a lower back of a user. The base member has a massaging element disposed therein for providing a massaging action to the lower back of the user. A back support arm is removably coupled with respect to the base member. A neck support is positionable around a neck of the user. The neck support is secured to the back support arm. The neck support has a generally U-shaped configuration defined by opposed free ends. The neck support includes a pair of massaging elements disposed within the opposed free ends thereof. A control panel is secured to the neck support. The control panel is in communication with the massaging element of the base member and the pair of massaging elements of the neck support. The control panel includes a timer. The timer has control buttons. The control panel includes a display. The control panel programs the activation of the massaging elements at timed intervals.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a rear view of the preferred embodiment of the programmable neck massaging device constructed in accordance with the principles of the present invention.

FIG. 2 is a top plan view of the present invention.

FIG. 5 is a perspective view of the massaging elements of the present invention.

FIG. 6 is a front view of one of the massaging elements illustrated in use.

The same reference numerals refer to the same parts through the various figures.

DESCRIPTION OF THE PREFERRED EMBODIMENT

Figure 4:
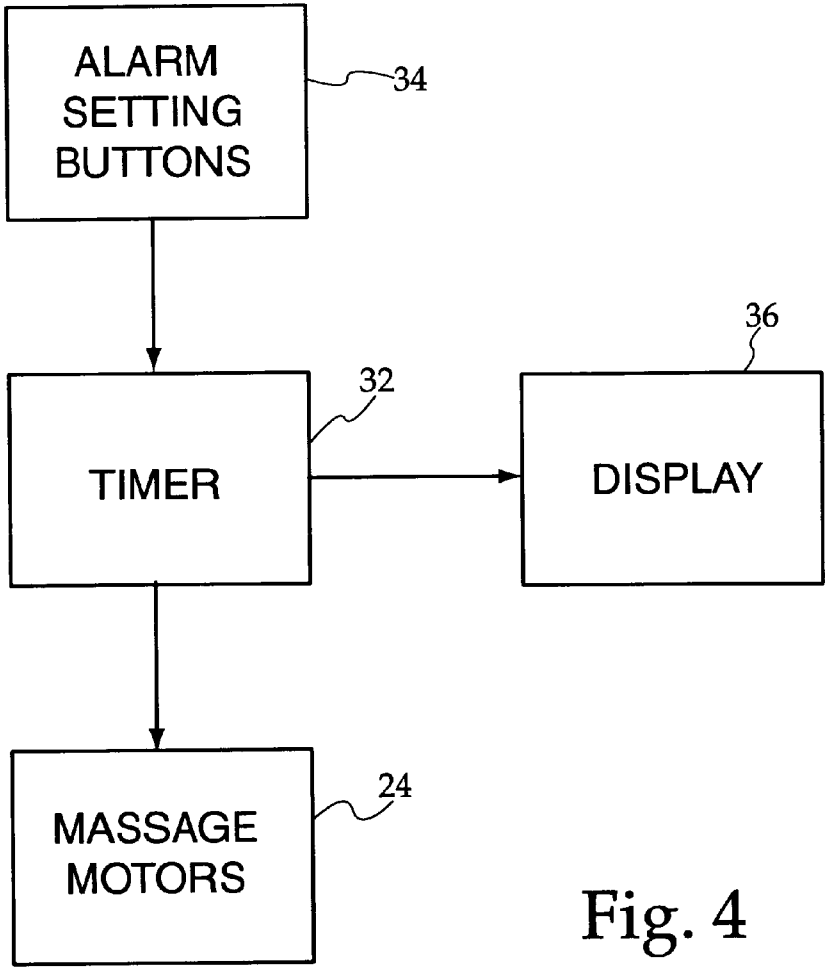
FIG. 4 is a schematic illustration of the operation of the present invention.
Figure 3:
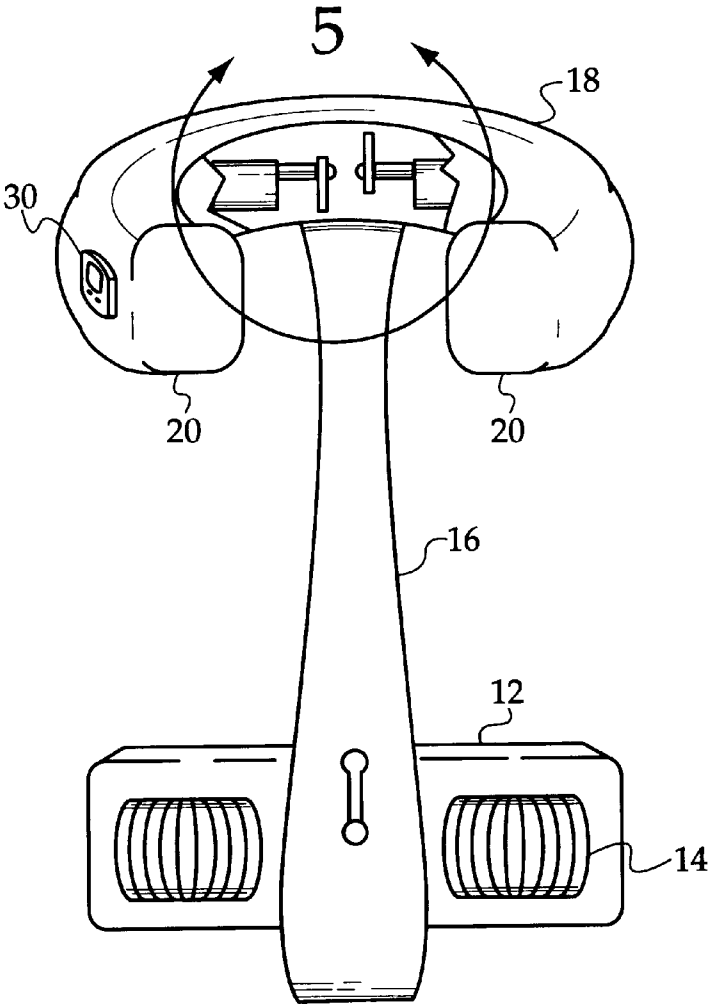
FIG. 3 is a front elevation view of the present invention.

With reference now to the drawings, and in particular, to FIGS. 1 through 6 thereof, the preferred embodiment of the new and improved programmable neck massaging device embodying the principles and concepts of the present invention and generally designated by the reference number 10 will be described.

Specifically, it will be noted in the various Figures that the device relates to a programmable neck massaging device for providing massaging action to a neck of a person at set intervals to prevent the person from falling asleep. In its broadest context, the device consists of a base member, a back support arm, a neck support, and a control panel. Such components are individually configured and correlated with respect to each other so as to attain the desired objective.

The base member 12 is positionable at a lower back of a user. Note FIG. 1. The base member 12 has a massaging element 14 disposed therein for providing a massaging action to the lower back of the user.

The back support arm 16 is removably coupled with respect to the base member 12. The back support arm 16 is curved to conform to a back of the user. Note FIG. 2. The back support arm 16 has an upper end and a lower end. The lower end is couplable with the base member 12.

The neck support 18 is positionable around a neck of the user. The neck support 18 is secured to the upper end of the back support arm 16. The neck support 18 has a generally U-shaped configuration defined by opposed free ends 20. The neck support 18 includes a pair of massaging elements 22 disposed within the opposed free ends 20 thereof. Each of the massaging elements 22 include a motor portion 24. The motor portion 24 has an arm 26 extending outwardly therefrom. The arm 26 has a rotating disc 28 disposed thereon whereby activation of the motor 24 will cause the rotating disk 28 to spin in a constant circular motion. Each rotating disc 28 has a generally oval configuration.

The control panel 30 is secured to the neck support 18. The control panel 30 is in communication with the massaging element 14 of the base member 12 and the pair of massaging elements 22 of the neck support 18. The control panel 30 includes a timer 32. The timer 32 has control buttons 34. The control panel 30 includes a display 36. The control panel 30 programs the activation of the massaging elements 14, 22 at timed intervals. Thus, using the control panel, the user can program how often they want the massaging elements to be activated. Using the control buttons 34 and the display 36, the user can program how often they want the massaging elements 14, 22 to be activated. A person driving a vehicle may want the massaging elements 14, 22 to be activated every few seconds while a person requiring a short nap can program the activation at longer intervals. Additionally, the control panel 30 could be provided with a manual shut off button to deactivate the massaging elements 14, 22 or the massaging elements 14, 22 could be activated for a predetermined amount of time before shutting off automatically.

The base member 12, the back support arm 16, and the neck support 18 are all conformable to the specific shapes of individual users. Additionally, the base member 12 and the neck support 18 will be padded to provide comfort to the user.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A programmable neck massaging device for providing massaging action to a neck of a person at set intervals to prevent the person from falling asleep comprising, in combination:

a base member positionable at a lower back of a user, the base member having a massaging element disposed therein for providing a massaging action to the lower back of the user;

a back support arm removably coupled with respect to the base member, the back support arm being curved to conform to a back of the user, the back support arm having an upper end and a lower end, the lower end being couplable with the base member;

a neck support positionable around a neck of the user, the neck support secured to the upper end of the back support arm, the neck support having a generally U-shaped configuration defined by opposed free ends, the neck support including a pair of massaging elements disposed within the opposed free ends thereof, each of the massaging elements including a motor portion, the motor portion having an arm extending outwardly therefrom, the arm having a rotating disc disposed thereon whereby activation of the motor will cause the rotating disk to spin in a constant circular motion, each rotating disc having a generally oval configuration; and a control panel secured to the neck support, the control panel being in communication with the massaging element of the base member and the pair of massaging elements of the neck support, the control panel including a timer, the timer having control buttons, the control panel including a display, the control panel programming the activation of the massaging elements at timed intervals.

2. A programmable neck massaging device for providing massaging action to a neck of a person at set intervals to prevent the person from falling asleep comprising, in combination:

a base member positionable at a lower back of a user, the base member having a massaging element disposed therein for providing a massaging action to the lower back of the user;

a back support arm removably coupled with respect to the base member;

a neck support positionable around a neck of the user, the neck support secured to the back support arm, the neck support having a generally U-shaped configuration defined by opposed free ends, the neck support including a pair of massaging elements disposed within the opposed free ends thereof; and a control panel secured to the neck support, the control panel being in communication with the massaging element of the base member and the pair of massaging elements of the neck support, the control panel including a timer, the timer having control buttons, the control panel including a display, the control panel programming the activation of the massaging elements at timed intervals.

3. The programmable neck massaging device as set forth in claim 2, wherein the back support arm is curved to conform to a back of the user.

4. The programmable neck massaging device as set forth in claim 2, wherein each of the massaging elements of the neck support includes a motor portion, the motor portion having an arm extending outwardly therefrom, the arm having a rotating disc disposed thereon whereby activation of the motor will cause the rotating disc to spin in a constant circular motion.

5. The programmable neck massaging device as set forth in claim 4, wherein each rotating disc has a generally oval configuration.

* * * * *